US005295883A

United States Patent [19]

Moran

[11] Patent Number: 5,295,883

[45] Date of Patent: Mar. 22, 1994

[54] BODYBOARD WITH STIFFENING REINFORCEMENT

[75] Inventor: Steven M. Moran, Long Beach, Calif.

[73] Assignee: Kransco, San Francisco, Calif.

[21] Appl. No.: 656,556

[22] Filed: Feb. 15, 1991

[51] Int. Cl.[5] ..... B63B 1/00

[52] U.S. Cl. ..... 441/65; 114/357

[58] Field of Search ..... 441/65, 74, 79, 68; 114/357, 39.2; 428/71, 76

[56] References Cited

U.S. PATENT DOCUMENTS

| | | | |
|---|---|---|---|
| 3,514,798 | 6/1970 | Ellis | 441/74 |
| 3,543,315 | 12/1970 | Hoffman | 441/74 |
| 3,776,563 | 12/1973 | Tigert | 280/11.3 |
| 4,071,264 | 1/1978 | Legrand et al. | 280/610 |
| 4,209,867 | 7/1980 | Abrams, III | 441/74 |
| 4,297,796 | 11/1981 | Stirtz et al. | 36/28 |
| 4,753,836 | 6/1988 | Mizell | 441/74 |
| 4,892,054 | 1/1990 | Davidson | 114/357 |

FOREIGN PATENT DOCUMENTS

| | | | |
|---|---|---|---|
| 3019535 | 11/1981 | Fed. Rep. of Germany | 441/74 |
| 3406689 | 8/1985 | Fed. Rep. of Germany | 441/74 |
| 8300127 | 1/1983 | PCT Int'l Appl. | 441/74 |

*Primary Examiner*—Edwin L. Swinehart
*Attorney, Agent, or Firm*—Kolisch, Hartwell, Dickinson, McCormack & Heuser

[57] ABSTRACT

A bodyboard for riding ocean surf is provided which includes a layer of stiffening material beneath the outer skin of the board in selected regions of the board. The stiffening material is in the form of one or more layers of open-weave or open pattern, crosshatched fiber mesh laminated into the semi-rigid foam which makes up the majority of the board's interior. The stiffening material is preferably located adjacent the bottom skin of the board in order to resist or inhibit creasing of the planing surface on which the board rides. The board retains sufficient flexibility for maneuvering and for comfort, while resisting bottom skin damage due to stresses exerted on the board in use. Alternative embodiments of the invention include using stiffening mesh beneath the side rails of the board and using one or more additional layers of stiffening mesh in selected regions between the foam core and the outer skin of the bodyboard.

3 Claims, 4 Drawing Sheets

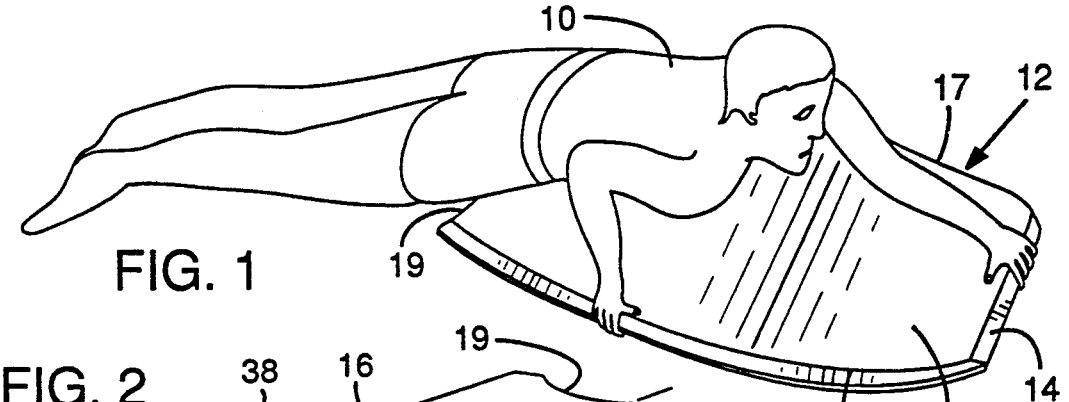
FIG. 1
FIG. 2
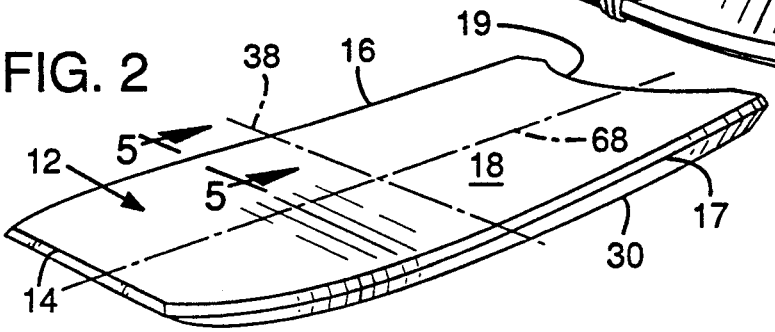
FIG. 3
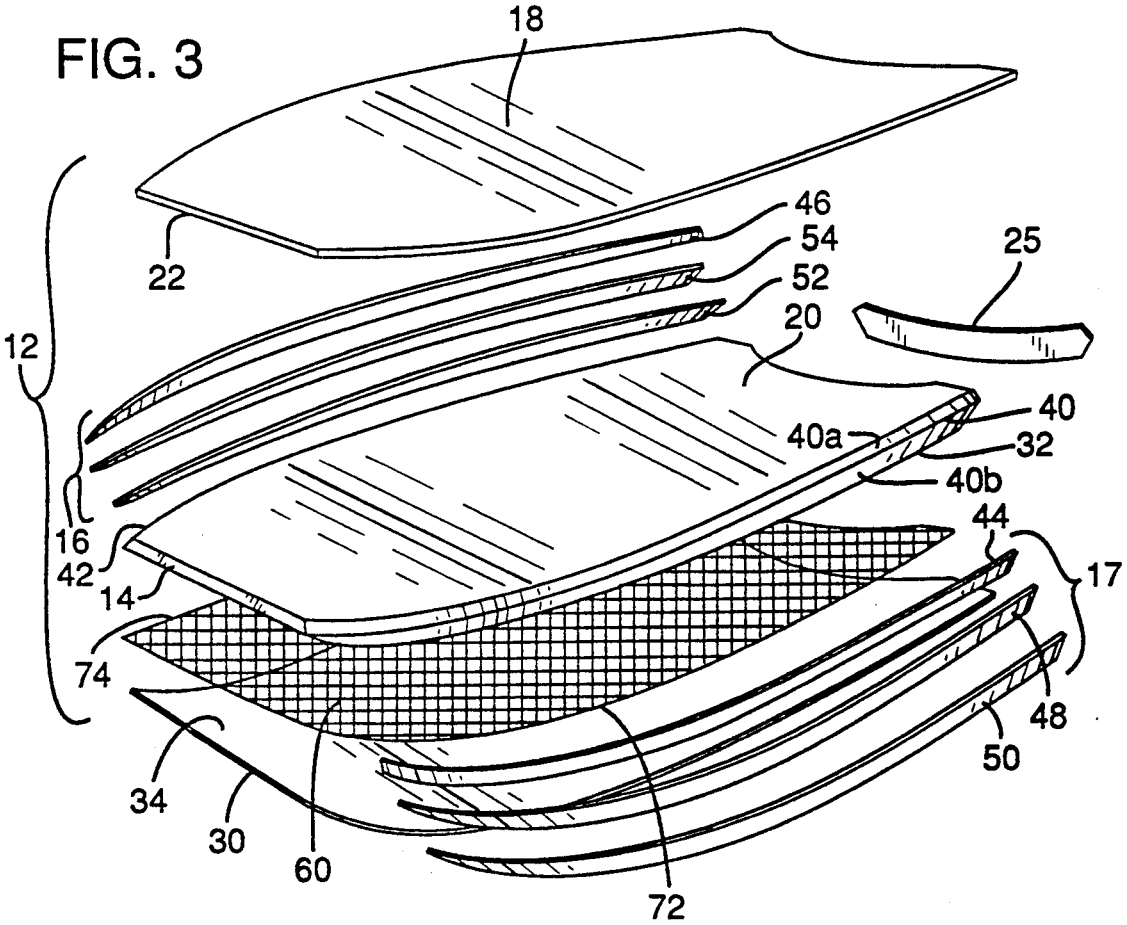

BODYBOARD WITH STIFFENING REINFORCEMENT

BACKGROUND AND SUMMARY OF THE INVENTION

The invention relates generally to sporting goods and recreational products, and more particularly to a bodyboard for use in riding ocean surf.

Bodyboards are flotation amusement devices for riding waves. They are similar to surfboards, with the major differences being that bodyboards are shorter, lighter and generally more flexible than surfboards. In form, a bodyboard is a contoured, elongated, foam plank having a plastic bottom skin, which is generally slick and shiny to enhance planing on the surf, and a top riding surface of foam or plastic.

Bodyboards are traditionally ridden in a prone or procumbent position, with one arm extending forwardly for gripping the nose end of the board and the other arm positioned in a trailing manner for gripping a side edge. In this position, the rider can push or pull against the front or side edges, bending or twisting the board to assist in maneuvering. The rider's legs, which trail the board, also help with steering and maneuvering.

The stiffness or flexibility of a bodyboard greatly influences its riding and control characteristics. Some bodyboards are manufactured like surfboards, with a very stiff core and a hard outer skin. Such hard, inflexible bodyboards are difficult to maneuver because, lacking flexibility, the rider cannot adjust the shape of the board. In general, very stiff bodyboards tend to be the most expensive models, but are not favored by the more skilled bodyboard riders. Stiff bodyboards do have the advantage of being sturdy and not easily susceptible to breakage, although they can potentially injure the rider or others if the board happens to collide with a person in the surf.

Far more popular among experienced bodyboard riders are relatively flexible boards which generally have a core made of semi-rigid foam. Such flexible, bendable bodyboards permit the rider to adjust the drag characteristics of the board by bending the nose upwardly or twisting the board to facilitate maneuvering. Flexible boards are increasingly popular among riders who wish to perform the numerous maneuvers and tricks which make bodyboarding the fast-paced, exhilarating sport it has become. Tricks such as the "el rollo," "belly spinners," and others involve daring and precise maneuvers mandating that the rider have complete control over the board. In addition to being maneuverable, flexible boards also can be safer to ride in heavy surf because they are softer and less likely to cause injury should the board break loose and collide with the rider or others.

Flexibility in bodyboard design is relative, meaning the flexible boards are comparatively more flexible than ultrastiff boards. Yet, even the flexible boards are stiff enough to retain their shape and cannot be bent or folded beyond a certain point without damage to the board structure. In general, a flexible bodyboard will be flexible enough for the rider, exerting a reasonable force with his arms and body, to twist a four-foot long board perhaps four-inches or so from its original shape and alignment. With a very stiff bodyboard, or a surfboard, a person of normal strength cannot twist or bend the board structure even by that amount. Consequently, even with a soft, bendable or flexible bodyboard, the board remains a relatively stiff device to which only subtle changes in shape are made by the exertions of the rider.

Flexible or bendable bodyboards are susceptible to creasing or breakage, making them more fragile than the stiff bodyboards. Because they are less rigid, softer bodyboards are more likely to be flexed beyond the critical compression point, at which permanent creases form. Typically, a board is damaged when the rider is thrown upon the board in heavy ocean surf after losing control. The flexible foam core then will bend far enough to crease the hard, shiny bottom surface, which alters the planing characteristics of the board permanently, making it sluggish and comparatively "dead." Once the bottom skin has been creased, the board often becomes unusable for high performance bodyboarding activities and the board must be replaced.

The trade-off in bodyboard design is to achieve the flexibility necessary for maneuvering without making the board too fragile or delicate for the rough and tumble of bodyboarding activity. Ideally, the bodyboard should be both flexible enough to perform popular bodyboarding maneuvers yet be strengthened against creasing or breakage. In addition, any strengthening of the bodyboard structure should be accomplished without adding excessive weight or otherwise adversely changing the size, shape or ride characteristics of the board.

It would be advantageous to provide a relatively flexible bodyboard which is lightweight and maneuverable but which is stiffened in selected regions to inhibit creasing of the board. I would also be advantageous for the stiffened board to retain sufficient flexibility to avoid the solid, very stiff feel of a surfboard or other relatively inflexible surf riding device.

It is an object of the present invention to provide a bodyboard that is flexible, yet is stiffened in selected regions of the board to inhibit creasing or breakage of the board.

It is another object of the present invention to provide a stiffened bodyboard which includes a layer of fiber mesh stiffening material laminated into the board structure to stiffen the board by a selected amount.

It is another object of the invention to provide a bodyboard stiffened with a layer of fiber mesh embedded within the internal foam structure of the board, wherein the mesh fibers are encapsulated within the surrounding foam, to retain flexibility while reinforcing the bodyboard.

Accordingly, the invention provides a bodyboard in the form of an elongate, substantially planar board having a semi-rigid foam core and having an outer skin which includes a top skin for supporting a rider extending over the upper surface of the core and a bottom skin for planing on water extending over the lower surface of the core. The improvement of the present invention comprises an expanse of stiffening material extending over selected regions of the board between the foam core and the outer skin. In one preferred embodiment, the stiffening means is in the form of an expanse or layer of stiffening material disposed between the bottom skin and foam core of the board. The stiffening layer is preferably fiber mesh with an open crosshatched pattern. The mesh is laminated between adjacent foam layers which are joined to one another through the openings in the mesh. The mesh preferably extends over the entire bottom surface of the board, although it could be applied in selected regions only, if desired. Alternative embodiments of the invention include applying a stiffening fiber mesh layer adjacent the top skin of the board. Yet another alternative embodiment includes applying a fiber mesh stiffening layer adjacent the side rails of the board.

BRIEF DESCRIPTION OF THE DRAWINGS

FIG. 1 is a perspective view of a bodyboard rider positioned on a bodyboard, the illustrated riding position being typical for prior art bodyboards as well as for the bodyboard of the present invention.

FIG. 2 is a perspective view of the bodyboard of the present invention as viewed from the front left corner of the bodyboard.

FIG. 3 is an exploded perspective view of the bodyboard of FIG. 2, on an enlarged scale, showing the various layers and parts of the bodyboard.

DETAILED DESCRIPTION OF THE PREFERRED EMBODIMENT

Figure 4:
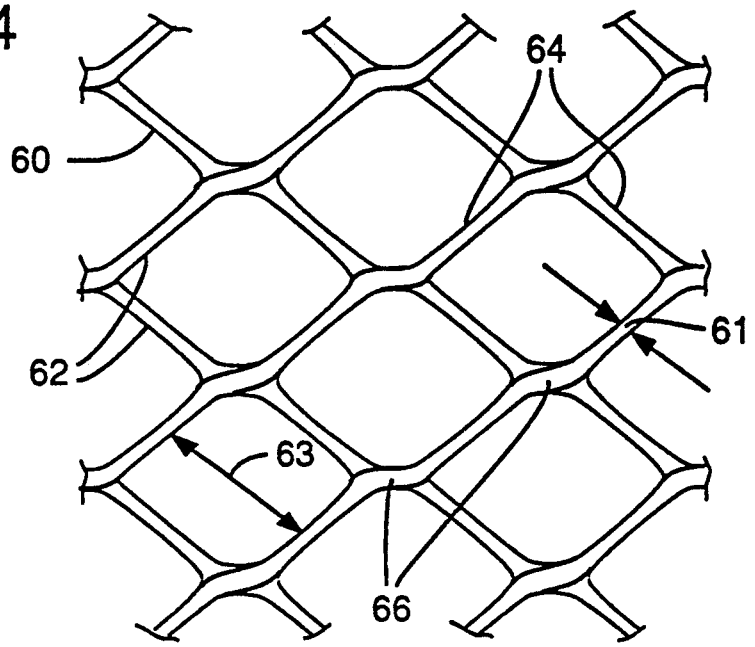
FIG. 4 is a plan view, on an enlarged scale, of a portion of the fiber mesh stiffening layer employed in the stiffening means of the present invention.

FIG. 1 shows a bodyboarder 10, also referred as a bodyboard rider 10, riding a bodyboard 12 in a typical riding position. One arm is extended forwardly gripping the nose end 14 of the bodyboard, while the other arm is disposed in a trailing manner for engaging one of the side rails which extend along the opposed lateral sides 16, 17 of the bodyboard. As illustrated, rider 10 is on his stomach, in a prone or procumbent position, and is partially propped up on the elbow of the forward left arm with his chest and torso overlying the top 18 of the board. His body extends beyond the tail or rear end 19 of the board with his legs trailing in the water. In this position, the rider steers or maneuvers the board by leaning, use of his legs, and manipulation of the board with his hands and arms.

The structure of bodyboard 12 is illustrated in greater detail in FIGS. 2 and 3. Bodyboard 12 is an elongate, substantially planar board having a generally layered construction. The heart of the board structure is a semi-rigid foam core 20, which forms a major portion of the interior volume of the board. Foam core 20 is made of a closed cell expanded polyolefin foam, preferably of a type specially fabricated for use in bodyboards. The preferred product for use in foam core 20 is called WAVECORE®, which is a high quality ETHAFOAM® product made by Dow Chemical Company. Foam core 20 is relatively stiff and dense and, although resiliently deformable, will tend to retain its shape and define the overall shape of the bodyboard. In a typical board of approximately 4-feet in length, foam core 20 is 2-inches to 3-inches in thickness at the midportion of the board and tapers downwardly to a smaller thickness adjacent nose end 14. Foam core 20 curves upwardly from the midpoint of the board toward the nose and tail ends, defining nose and tail rockers, which are upwardly curving planing surfaces on the bottom of the board. A forward-arching concave indentation is formed in the tail end 19 of the board, defining what is known as a swallow tail.

The exterior surfaces or exterior skin of the bodyboard includes a top skin for supporting a rider, a bottom skin for planing on water, elongate laterally-opposed side edges and a tail piece covering the swallow tail. The rest of the board structure, filling the interior of the board within the exterior skin, is semi-rigid foam, most of that foam being foam core 20. The top skin layer 22 covers the top of board 12, extending from the top surface 18 of the board downwardly or inwardly a short distance into the board structure. Top skin layer 22 is a thin layer of foam such as closed cell expanded polyolefin foam. The top skin is usually one-quarter-inch or less in thickness, extending over the upper surface 24 of foam core 20 and providing the riding surface on the top surface 18 of the board. One or more intermediate foam layers (not shown) may also be provided between top skin layer 22 and the top surface 24 of foam core 20, if desired. The technique used to bond adjacent foam layers to one another is known as thermolamination, which is a heat and adhesive process well known in the art. Thermolamination is used to bond the top and bottom skins, and the side edge coverings described below, to core 20. A tail piece 25 is also bonded to the tail end 19 of foam core 20 by thermolamination.

The bottom skin 30 extends over and covers the underside or lower surface 32 of foam core 20 to provide a planing surface for planing on ocean surf. Bottom skin 30 is preferably formed of a friction-reducing, relatively hard, shiny plastic which is generally one-sixteenth-inch or less in thickness and provides a nonfoam surface which is tough and resilient. One product suitable for use as bottom skin 30 is Surlyn®, made by DuPont. The plastic outer surface of bottom skin 30 is generally backed by a relatively thin layer of foam 34 (see FIG. 4) such as a closed cell expanded polyolefin foam or Ethafoam®. Backing foam 34 is generally one-quarter-inch or less in thickness and is bonded to the plastic outer skin layer by the manufacturer of the bottom skin. Both the nonfoam plastic layer 30 and the foam backing layer 34 are referred to together as bottom skin 30. In the intermediate region between the bottom skin 30 and the underside 32 of foam core 20 is a stiffening layer of fiber mesh which forms the stiffening means of the first embodiment of the present invention, described in detail below.

The longitudinal side edges 16, 17 of board 12 taper toward one another adjacent nose end 14, making the nose portion of the board narrower than the middle of the board (the middle or midportion of the board is indicated at 38 in FIG. 2). The longitudinal sides 40, 42 of foam core 20 are beveled, as are the side edges 16, 17 of the bodyboard. Referring to FIGS. 3 and 4, the left side edge 40 of foam core 20 includes upper beveled edge 40*a* and lower beveled edge 40*b*. The right side edge of foam core 20 includes an upper beveled edge 42*a* and lower beveled edge 42*b*. Elongated foam pieces 44, 46, called chines, are thermolaminated to upper beveled side edges 40*a*, 42*a*, respectively, and form part of the outer skin of the bodyboard. The lower beveled side edge 40*b*, 42*b* are each covered with one or more elongated foam pieces known as rails, which are also part of the outer skin. Bodyboard 12 includes two-layer rails, made of closed cell expanded polyolefin foam or Ethafoam ®, attached to each lower beveled side edge 40*b*, 42*b*. An inner rail is thermolaminated onto the lower beveled edge of the foam core, and an outer rail covers and is thermolaminated to each inner rail. The left side rails include inner rail 48 thermolaminated to lower beveled edge 40*b* and an outer rail 50 thermolaminated to inner rail 48. The right side rails include inner rail 52 thermolaminated to lower beveled edge 42*b* of foam core 20 and an outer rail 54 thermolaminated to inner rail 52.

The chines and side rails provide longitudinal strengthening to the board structure and help define the hydrodynamics of the board as it moves through water. Also, if the chines and outer rails are fabricated in colors which contrast with the top or bottom skin, they contribute to the distinctive appearance of the board.

Figure 5:
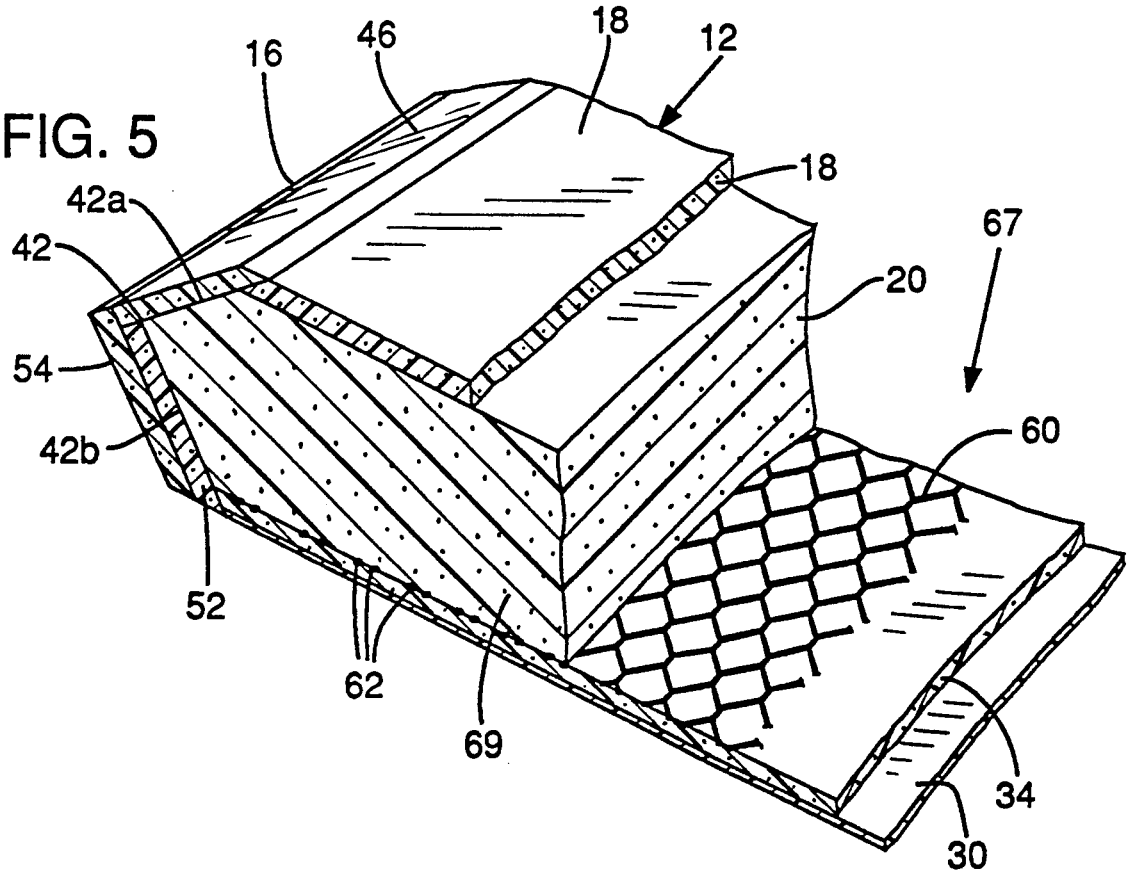
FIG. 5 is a perspective view of a slice of the bodyboard of FIG. 2, on an enlarged scale, taken along the right longitudinal side edge of the bodyboard generally between section lines 5—5 of FIG. 2, illustrating the layered construction of the bodyboard and the location of the fiber mesh stiffening layer in the first embodiment of the present invention.

One important feature of the present invention is the provision of stiffening means for stiffening selected regions of the board. The stiffening means is in the form of an expanse of stiffening material extending over selected regions of the board, preferably extending between foam core 20 and the outer skin of the board. In a first embodiment of the invention, the stiffening means includes a layer 60 of stiffening material disposed between bottom skin 30 and foam core 20. Referring to FIGS. 3, 4 and 5, stiffening layer 60 includes an expanse of open weave or open pattern, crosshatched fiber mesh made up of spaced-apart thermoplastic fiber filaments 62 which are interlocked together at selected intersection points. The individual filaments of the fiber mesh are made of a thermoplastic material which includes at least one of the following: polyethylene and polypropylene. Preferably the filaments 62 are a composite or blend of polyethylene and polypropylene. Alternatively, another suitable filament material which is strong and flexible could be used for the fibers in mesh 60.

Fiber mesh stiffening layer 20 is shown most clearly in FIGS. 4 and 5. It is made up of two intersecting parallel arrays of the above-described fiber filaments or strands 62. Thought of in another way, the fibers are two generally parallel spaced-apart grillwork patterns which intersect one another to form an open, crosshatched pattern. Each of the fiber strands has a diameter 61 or thickness in the range of about 0.02-inch to 0.1-inch, with the preferred diameter being approximately 0.043-inch. The spacing 63 between adjacent non-intersecting (parallel) fibers in the crosshatched pattern is in the range of about 0.375-inches to 1.25-inches, forming openings 64 between or enclosed by adjacent fiber strands. The preferred spacing between parallel strands is approximately 0.6-inches and the area of each opening is approximately 0.4-square inches. The fibers in the mesh are locked together or interlocked at selected intersection points 66, which preferably is at every intersection 66 between crossing fibers, although only selected intersection points may alternatively be interlocked. The fibers are interlocked during fabrication of the mesh by thermomelting or another suitable interlocking process. In its final form, the mesh has an overall ratio of fiber diameter 61 (thickness)-to-fiber opening area 64 in the range of between about 1-to-8 and 1-to-25. The preferred strand diameter/opening area ratio is approximately 1-to-15.

In the first embodiment of the present invention, a layer of fiber mesh 60 cover and is coextensive with substantially the entire underside 32 of foam core 20, meaning it is also adjacent and coextensive with the bottom skin 30 of the board. The fiber mesh serves as a stiffening means for stiffening the regions of the board in which the fiber mesh is embedded. Referring to FIG. 5, bottom skin 30 is a thin, relatively hard sheet of non-foam plastic to which foam backing layer 34 is attached. Foam backing layer 34 is illustrated as a layer of closed cell expanded foam slightly thicker than the bottom plastic layer.

In the area 67 of FIG. 5, where foam core 20 is cut away to illustrate the board construction, mesh 60 is shown overlying foam backing layer 34. When the bodyboard is fully assembled, mesh layer 60 is embedded between foam core 20 and the bottom skin foam backing layer 34. Attachment of the fiber mesh layer 60 to the layered structure of board 12 is accomplished by bonding together the foam layers immediately adjacent the fiber mesh through the openings in the mesh. During assembly of the bodyboard, mesh layer 60 is positioned between foam backing layer 34 and the underside of foam core 20, with the fiber strands in the mesh oriented diagonally relative to the longitudinal center line 68 of the board (see FIG. 3). The underside of core 20 and foam backing layer 34 are then joined or bonded to one another by thermolamination in those areas between the fiber strands where the foam layers contact one another. The result is that the two adjacent foam layers become joined to one another through the openings 64 in the open weave mesh.

Bonding the adjacent foam layers together through openings 64 embeds the mesh in the foam which substantially fills the interior of board 12. The embedding of the fiber mesh within the foam structure of the board is illustrated schematically in FIG. 5 by the fiber strands 60 sandwiched between foam core 20 and backing layer 34 see the area 69 in FIG. 5 where cross-sectional cut exposes a slice of the board structure). Each fiber 62 or intersection point 66 is surrounded by foam. The upper half of each fiber strand is buried in the foam of core 20 and the lower half is buried in foam backing 34. That locks the mesh into place within the board structure.

The technique of embedding the fiber mesh reinforcing layer within the foam in the interior of the bodyboard is used in both the first embodiment of the present invention and the alternative embodiments described below. In each of the embodiments, the board structure includes at least one layer of foam extending beneath the outer surface of the board and overlying the foam core. The layer of foam extending beneath the outer surface provides a surface of foam facing inwardly toward the foam core, and the fiber mesh layer used to stiffen the board can be sandwiched between the core and that surface of foam. On the top side of the bodyboard, top skin layer 22 overlies foam core 20 and a fiber mesh layer can be interposed between the foam of top skin 22 and core 20. On the side edges of the bodyboard, foam chines 44, 46 are attached to foam core 20 and the fiber mesh layer can be interposed between the foam layers. Inner and outer side rails 48, 50, 52, 54 provide adjacent foam surfaces between which the fiber mesh can be interposed. On the bottom of the bodyboard, foam backing layer 34 and foam core 20 provide adjacent foam surfaces into which the foam mesh layer is interposed. In each of the selected regions of the board where an expanse of stiffening material can be installed, there exists adjacent foam layers with facing foam surfaces which are joined to one another within the board structure. In each such region, fiber mesh can be installed between the adjacent foam surfaces and embedded within the foam by joining the adjacent foam surface to one another through the openings between the fibers in the mesh.

Since the fibers are generally flexible but strongly resist stretching or compression, the fiber mesh strengthens the board by making is resistant to elastic deformation in directions aligned with the fiber strands. Since the fibers are interlocked with the foam material in the immediate vicinity of the mesh, the interior foam in selected regions of the bodyboard also becomes resistant to elastic deformation in the directions aligned with the fiber strands. The diagonal orientation of the fibers relative to the longitudinal center line 68 of the bodyboard allows some very limited elastic deformation (i.e., stretching and compression) in the direction parallel to center line 68, and also transverse to the center line, and inhibits deformation in other directions. The board is even reinforced in the direction aligned with center line 68 because the mesh will to some extent resists elongation of mesh openings 64. The mesh thereby permits limited flexure of the board in the fore-and-aft direction, which is most important for controlling the bodyboard. As a consequence, the board is generally stiffened, without making it too rigidly inflexible.

The first embodiment of FIGS. 3 and 5 is specifically designed to stiffen the relatively hard bottom skin of the bodyboard which is most sensitive to creasing. Bodyboards such as bodyboard 12, fabricated predominately out of semi-rigid foam with a slick, shiny bottom skin, are susceptible to bottom skin damage. If the board is bent or flexed, the foam parts of the board will stretch or compress, usually without damage, but if the stretching or compression exceeds a certain amount, the bottom skin permanently creases. Such damage to the bottom skin is highly deleterious to the performance of the board, making it sluggish or "dead." The first embodiment of the invention is designed to resist damage to the bottom skin by stiffening the board in the vicinity of the bottom skin.

The extent of reinforcing mesh layer 60 is a matter of design choice, depending on where and how much stiffening is called for by the board architect. Larger or smaller expanses of fiber mesh, or a single or plurality of fiber mesh layers, can be installed in the foam interior of the board structure in order to stiffen the board by any selected amount. In the first embodiment of the invention, stiffening layer 60 covers substantially the entire underside of the foam core 20. As such, the stiffening layer extends along the underside 32 of foam core 20 from an area at or proximate nose end 14 to an area at or proximate tail end 19. The longitudinal sides 72, 74 of mesh 60 (FIG. 3) extend from an area proximate to one of the side edges 16, 17 of the board to an area proximate the other side edge.

Figure 6:
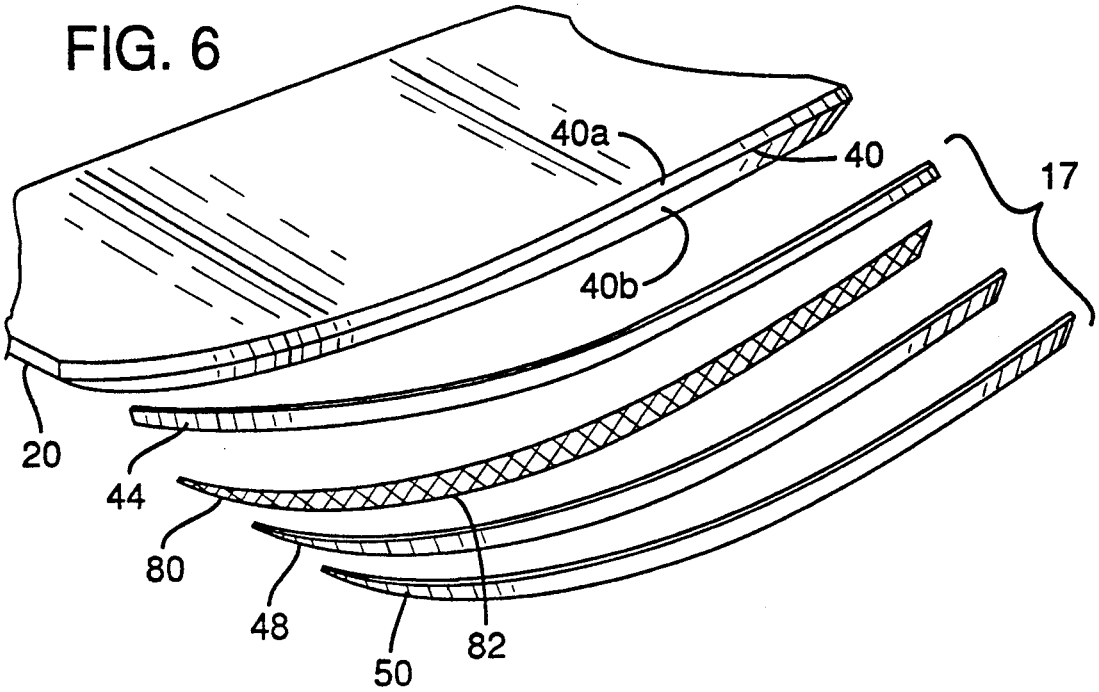
FIG. 6 is a partial, perspective, exploded view as in FIG. 3, illustrating an alternative bodyboard construction in accordance with the present invention.
Figure 7:
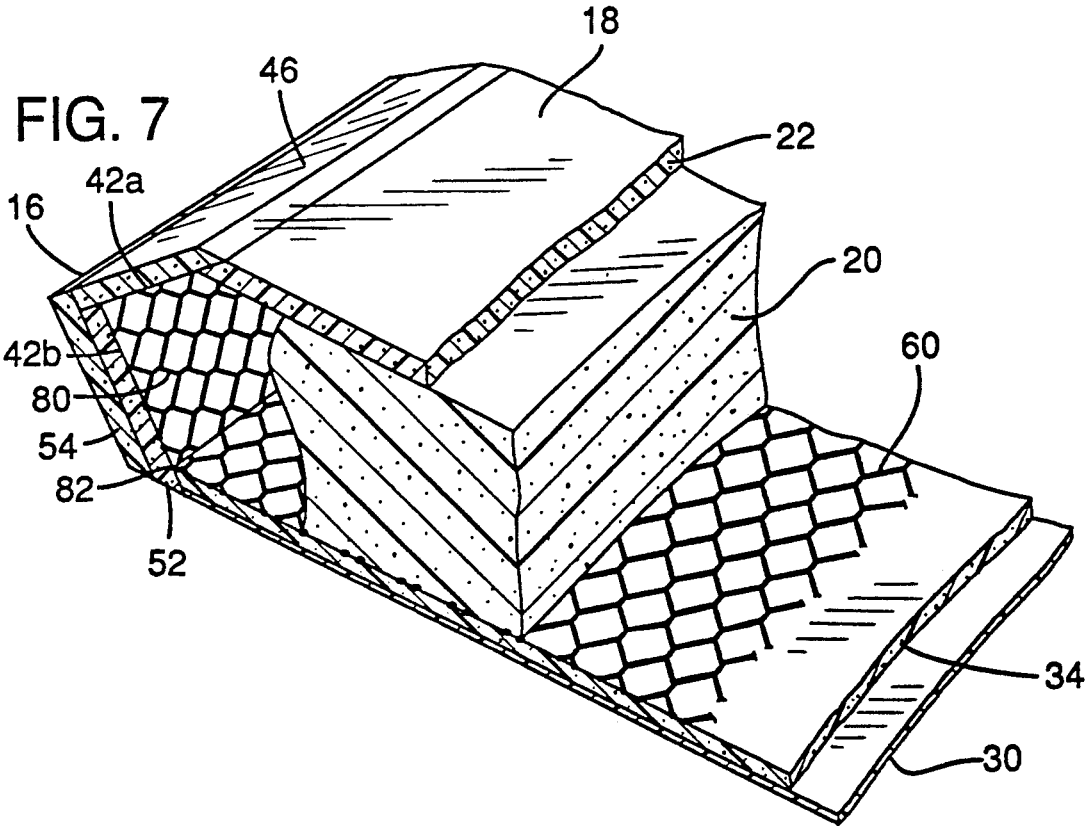
FIG. 7 is a perspective view, as in FIG. 5, of a slice of the right longitudinal side edge of the embodiment of FIG. 6.
Figure 8:
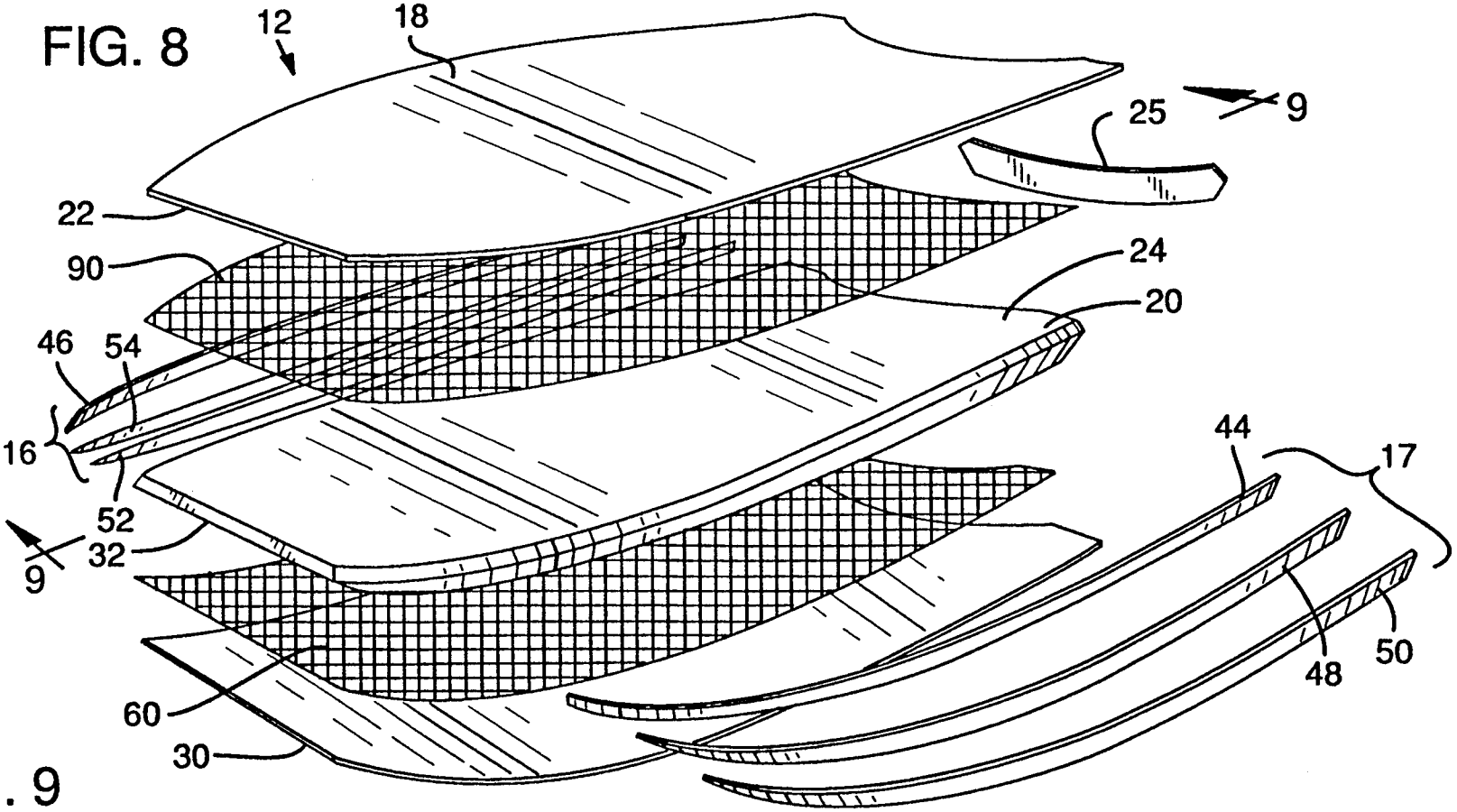
FIG. 8 is an exploded, perspective view as in FIG. 3 showing another alternative embodiment of the present invention employing two generally parallel layers of stiffening fiber mesh.
Figure 9:
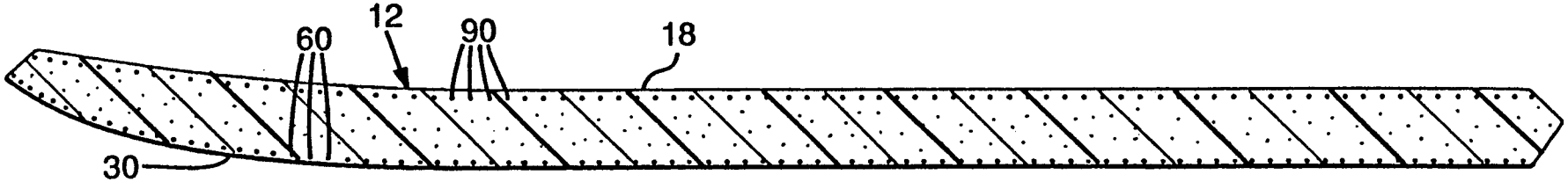
FIG. 9 is a partially schematic side, cross-sectional view of the assembled bodyboard of FIG. 8, taken along line 9—9 of FIG. 8.

Alternative embodiments of the present invention are illustrated in FIGS. 6, 7, 8 and 9. These alternative embodiments each include provision for stiffening other regions of the bodyboard other than bottom skin 30. In FIGS. 6 and 7, an expanse of stiffening material extends over portions of the side edges of the foam core 20, between the foam core and side rails of the bodyboard. In FIGS. 8 and 9, a second expanse of stiffening material extends adjacent the top skin of the bodyboard, together with the stiffening mesh layer 60 of the first embodiment. In each of the alternative embodiments, a fiber mesh layer like mesh 60 is incorporated into the structure of the bodyboard, beneath one or more selected regions of the outer skin of the board.

Referring to FIGS. 6 and 7, a first alternative embodiment bodyboard is shown which includes a continuous expanse of stiffening material between foam core 20 and the side rails of the board. Reference numbers used in the description of the first embodiment are repeated in FIGS. 6 and 7, except for features not found in the first embodiment. Only the left side of board 12 is shown in detail in the exploded view of FIG. 6, with certain details relating to the top and bottom sides of the bodyboard omitted. A slice of the right side of the board, as in FIG. 5, is shown in FIG. 7. In this embodiment of the invention, the lower beveled edges of foam core 20 are reinforced and stiffened with a layer of fiber mesh 80, which is interposed between foam core 20 and inner rails 48, 52. In FIG. 6, the lower beveled edge **40*b*, along left side of the board, is covered with the following layers (from innermost layer to outermost layer): fiber mesh stiffening layer 80, inner rail 48, and outer rail 50**.

Side rail stiffening mesh 80 is the same as bottom mesh 60 in composition, fiber size and fiber spacing. Incorporation of mesh 80 into the board structure is also the same as for underside mesh 60. The mesh 80 is interposed between adjacent foam layers, namely, foam core 20 and inner rails 48, 52, by joining the rails and the foam core to one another through the openings between the fibers in the mesh. In that way, the fibers of the mesh are embedded in and surrounded by the foam of foam core 20 and the inner side rails. FIG. 6 illustrates side rail reinforcing mesh 80 on the left side of board 12. FIG. 7 illustrates in cross-section a portion of the right side showing an equivalent reinforcing mesh 80 on the right side of the board. Inclusion of the bottom mesh 60, together with side rail mesh 80, is optional in the second embodiment. Side rail reinforcing mesh 80 may be used alone, without bottom reinforcing mesh 60.

Whether the board structure includes or omits bottom reinforcing mesh 60, the side rail stiffening means of the second embodiment employs fiber mesh stiffening material extending from adjacent bottom skin 30, along the lower edge 82 of mesh 80, and upwardly along portions of the side edges 16, 17 of the board. The extent of side rail stiffening mesh 80 is a matter of design choice. The mesh can be coextensive with the full length of the side rails of the bodyboard, as shown in FIGS. 6 and 7, or installed only in selected portions of the side edges where additional stiffening is desired. In that way, the board can be stiffened by any selected amount.

A third embodiment of the invention is shown in FIGS. 8 and 9. In this embodiment, the structure of the bodyboard incorporates more than one layer of stiffening or reinforcing mesh. One layer of stiffening mesh is positioned adjacent the bottom skin of the board, as in the first embodiment. In the embodiment of FIGS. 8 and 9, a second stiffening layer 90 is positioned adjacent the top skin of the board. Additional stiffening layers might also be positioned at other locations spaced from bottom layer 30. Thus, a plurality of stiffening layers can be included in the board structure.

Referring to FIGS. 8 and 9, in which the reference numbers used in the first embodiment are repeated for like elements, board 12 includes a central foam core 20 having a lower surface 32 covered by bottom mesh layer 60 and bottom skin 30. The upper surface 24 of core 20 is covered by an upper mesh layer 90 and top skin 22. Upper layer 90 of stiffening mesh is interposed between foam core 20 and top skin 22 in the same manner as lower mesh layer 60 is interposed between the foam core and the foam backing of bottom skin 30. Mesh layer 90 has the same structure as mesh layer 60 described above. Upper mesh layer 90 is installed in the board structure by thermolaminating together adjacent foam layers through the openings in the mesh. Since top skin layer 22 is itself made of foam, upper mesh layer 90 can be installed between top skin layer 22 and the upper surface of foam core 20, with the mesh layer sandwiched between the adjacent foam layers. Alternatively, one or more additional layers of foam may be installed between top skin layer 22 and foam core 20, in which case the upper stiffening mesh layer 90 is interposed between any of the adjacent foam layers.

It is preferred that upper reinforcing mesh 90 be generally coextensive with the stiffening layer 60 adjacent the bottom skin. FIG. 9 illustrates that both upper reinforcing mesh layer 90 and bottom reinforcing mesh layer 60 extend the full length of the bodyboard (interior foam layers are omitted in FIG. 9 for clarity, and to illustrate that the fiber mesh layers 60, 90 are embedded within the foam which fills the interior of the bodyboard). In bodyboards with a relatively thin bottom skin, if only the top skin is stiffened, any flexing of the bodyboard structure tends to concentrate near the bottom skin, increasing the likelihood of bottom skin damage. If both the upper and lower reinforcing mesh layers are generally coextensive, damage to the bottom skin is less likely. If both the upper and lower stiffening mesh layers extend over only limited portions of the bodyboard, it is recommended that the two parallel stiffening layers be approximately the same size and be located in the same general region of the bodyboard. Alternatively, a single layer of reinforcing mesh such as mesh layer 90 may be employed adjacent the top skin only, if a relatively heavy, thick bottom skin is used on the bodyboard, since a heavy bottom skin will itself tend to resist creasing.

With the stiffening layers anchored into the laminated structure of the board, as in FIGS. 8 and 9, the opposed, parallel reinforcing layers will function in the manner of an exoskelital structure, or in the manner of an I-beam or box girder, which strongly resists bending forces acting on the structure. Consequently, the embodiment of FIGS. 8 and 9 greatly stiffens the board structure, as compared with the use of only a single stiffening mesh layer 60 adjacent the bottom skin. If the board architect desires additional stiffening beyond the plurality of stiffening layers provided in the embodiment of FIGS. 8 and 9, a third or greater number of stiffening layers can be included in the board structure.

In general, it has been found that a single reinforcing mesh layer, applied adjacent the bottom skin of the board and covering substantially the entire underside of the board, results in the correct degree of stiffening for a semi-rigid foam board. The fiber mesh, which has a mass of 30 grams per/square foot, is light enough to add virtually no noticeable weight to the board. For example, in a bodyboard with a surface area of four square feet, a layer of fiber mesh coextensive with the bottom of the board would add 4-ounces to its weight. Nevertheless, the mesh substantially stiffens the board, allowing the board to resist the development of permanent creases in the bottom skin when the board is subjected to stress.

The bodyboard structure of the present invention combines the speed and fracture resistance of a stiff, hard board, with the comfort and maneuverability of softer boards. The resultant board structure is stiff enough to resist folding, creasing or breaking of the board during most bodyboarding activities without being so stiff and hard that it does not have a good "feel" when ridden. The result is a relatively lightweight, agile, maneuverable board which is fast and sturdy. In each of the above-described embodiments of the bodyboard, the sheet or expanse of fiber mesh stiffening material extends over selected regions of the board between the foam core and the outer skin of the board. By selecting the region or regions stiffened by the fiber mesh layer, the board architect can select and control the degree of additional stiffening applied to the board. One or more continuous sheets of the fiber mesh can be embedded in the foam which fills the interior of the bodyboard, spreading the reinforcement over selected regions of the board to achieve desired stiffness objectives.

Alternative bodyboards incorporating the stiffening means of the present invention include boards which are stiffened over only a portion of the surface areas indicated in the above-described embodiments. For example, the board could include stiffening means located along the central longitudinal axis of the board, adjacent the bottom skin, which does not extend to the side edges. Alternatively, the stiffening means could extend along the underside of the board to points spaced from the nose and tail and spaced inwardly from the side edges. In other words, only the central underside of the board could be stiffened, leaving the areas along the perimeter of the board unstiffened. Another alternative embodiment of the invention is to install a fiber mesh stiffening layer directly against the plastic bottom skin and an adjacent foam layer, rather than between the foam backing layer and an adjacent foam layer. A suitable adhesive or nonfoam spacer could be used to secure the mesh to the interior surface of the bottom skin and to embed the mesh in the structure of the bodyboard. Yet another alternative embodiment in accordance with the present invention is a bodyboard incorporating two or more additional reinforcing layers which are generally coextensive with the reinforcing layer near the bottom skin of the board. Different forms of the stiffening means of the present invention could also be employed, such as different shapes and configurations of the fiber mesh. These and other alternative bodyboard constructions incorporating sheets or expanses of stiffening material are possible within the scope of the present invention.

A bodyboard has been provided which includes a fiber mesh reinforcing layer laminated into the board structure near the bottom skin of the board, with the fiber mesh embedded between adjacent foam layers which encapsulate the mesh fibers within the foam on the interior of the board. The laminated, encapsulated fiber mesh provides a lightweight, effective stiffening means which stiffens the board sufficiently to inhibit creasing or breakage without making the board too stiff or hard.

While the present invention has been shown and described with reference to the foregoing preferred embodiment, it should be apparent to those skilled in the art that other changes in form and detail may be made without departing from the scope and spirit of the invention as defined in the appended claims.

What is claimed is:

1. A bodyboard, comprising:

an elongate board having a semi-rigid foam core, a bottom skin covering the underside of the foam core providing a surface for planing on water, at least one layer of foam between the bottom skin and the foam core, a stiffening layer in the form of an open pattern, crosshatched fiber mesh formed of thermoplastic nonfoam fibers interlocked together at selected intersection points and having openings between the fibers in the open pattern, wherein the ratio of fiber thickness-to-fiber opening area is in the range of between about 1-to-8 and 1-to-25, and the fiber mesh being generally coextensive with the bottom skin of the board and interposed between the layer of foam and the foam core, and the layer of foam and the foam core being joined to one another through the openings between the fibers in the mesh, whereby the fibers of the mesh are embedded in and surrounded by foam.

2. A bodyboard in the form of an elongate substantially planar board having a semi-rigid foam core and an outer skin which includes a top skin for supporting a rider extending over the upper surface of the core and a bottom skin for planing on water extending over the lower surface of the core, the bodyboard comprising:

at least one layer of foam beneath the surface of the outer skin extending between the outer skin and the foam core in selected regions of the board, an expanse of stiffening material extending between the foam core and the at least one layer of foam in selected regions of the board, the stiffening material being in the form of a sheet of open pattern, crosshatched fiber mesh and the foam core and foam layer being joined to one another through the openings between the fibers in the mesh, whereby the fibers of the mesh are embedded in and surrounded by foam.

3. A bodyboard in the form of an elongate substantially planar board having a semi-rigid foam core and an outer skin which includes a top skin for supporting a rider extending over the upper surface of the core and a bottom skin for planing on water extending over the lower surface of the core, the bottom skin including at least one backing layer of foam extending between the bottom skin and the foam core, the improvement comprising:

an expanse of stiffening material in the form of a sheet of open pattern, crosshatched fiber mesh positioned in selected regions adjacent the bottom skin between the backing layer of foam and the foam core, the backing layer of foam being joined to the core through the openings between the fibers in the mesh, whereby the fibers of the mesh are embedded in and surrounded by foam.

* * * * *